US006106255A

United States Patent [19]

Viegas et al.

[11] Patent Number: 6,106,255

[45] Date of Patent: Aug. 22, 2000

[54] HIGH EFFICIENCY ROTARY VANE MOTOR

[75] Inventors: Herman H. Viegas, Bloomington; Bruce E. McClellan, Richfield, both of Minn.

[73] Assignee: Thermo King Corporation, Minneapolis, Minn.

[21] Appl. No.: 09/113,833

[22] Filed: Jul. 10, 1998

Related U.S. Application Data

[60] Provisional application No. 60/057,011, Jul. 11, 1997.

[51] Int. Cl.[7] ..... F01C 21/00

[52] U.S. Cl. ..... 418/82; 418/268; 418/91; 418/152

[58] Field of Search ..... 418/268, 82, 91, 418/152

[56] References Cited

U.S. PATENT DOCUMENTS

| | | | |
|---|---|---|---|
| 3,824,046 | 7/1974 | Hanning | 418/82 |
| 4,242,065 | 12/1980 | Ishizuka et al. | 418/91 |
| 4,746,280 | 5/1988 | Wystemp et al. | 418/268 |
| 4,846,122 | 7/1989 | Kristof et al. . | |
| 5,087,180 | 2/1992 | Clapp | 418/152 |
| 5,947,712 | 9/1999 | Viegas | 418/268 |

FOREIGN PATENT DOCUMENTS

| | | | |
|---|---|---|---|
| 0 022 103 A1 | 1/1981 | European Pat. Off. . | |
| 323730 | 8/1920 | Germany | 418/268 |
| 388990 | 3/1933 | United Kingdom | 418/268 |

*Primary Examiner*—Thomas Denion
*Assistant Examiner*—Thai-Ba Trieu
*Attorney, Agent, or Firm*—Nawrocki, Rooney & Sivertson, P.A.

[57] ABSTRACT

A rotary vane motor adapted to operate at low rpm with a source of cryogenic pressurized gas. The rotary vane motor includes a housing having a cylindrical opening connected to a primary inlet assembly and an outlet assembly, a first and second end plate attached at opposite sides of the cylindrical opening, a rotor having a plurality of radially oriented, a plurality of vanes movable within the slots and a shaft for rotatably mounting the rotor in an eccentric position within the cylindrical opening. The first end plate includes a slot positioned for fluid communication with at least one of the rotor slots so as to direct pressurized fluid from a secondary inlet assembly. In the preferred embodiment, each of the plurality of vanes includes grooves for facilitating release of trapped fluid. During use, pressurized gas from the secondary inlet assembly forces the vanes radially outward relative to the rotor slots upon communication with first end plate slot such that any friction-causing problems are overcome.

10 Claims, 4 Drawing Sheets

HIGH EFFICIENCY ROTARY VANE MOTOR

This application is based upon prior Provisional Application 60/057,011 filed Jul. 11, 1997.

BACKGROUND OF THE INVENTION

The present invention relates to a rotary vane motor. More particularly, it relates to a rotary vane motor including forced vane expansion for effectively extracting mechanical energy from an expanding, cryogenic gas at low rotational speeds.

Rotary vane motors are well-known and accepted positive displacement machines. The standard rotary vane motor has numerous applications, such as for powering pneumatic wrenches and grinders, or other similar tools. Alternatively, rotary vane motors can be used in a variety of applications requiring forced rotation of a shaft otherwise connected to a separate device, such as a lift gate or cooling fan.

The conventional rotary vane motor typically comprises a housing having a cylindrical interior and a cylindrical rotor eccentrically mounted in an interior of the housing. The rotor, in turn, includes a plurality of uniformly spaced, radially oriented, slots for slidably receiving a plurality of rectangularly shaped vanes. Both the housing and the rotor are typically formed of metal. The eccentric placement of the rotor within the cylindrical enclosure defined by the housing leaves a gap between the rotor and the housing that is crescent-shaped in cross-section. Further, the vanes are designed to reciprocate in their respective slots as their outer edges sealingly and slidably engage the interior surface of the housing.

During use, pressurized fluid (such as compressed air) is admitted at an inlet port in the housing located in close proximity to one of the narrow ends of the crescent-shaped gap. Rotation of the rotor is initialized by the pressurized fluid pushing against the trailing faces of slidable vanes. As a result of the high speed of rotation, the vanes are flung outwards by the centrifugal force such that an outer edge of each of the vanes sealingly engages the inner surface of the housing. Due to the eccentricity of the rotor, the compartments between the vanes become alternately larger and smaller with rotation of the rotor. Finally, the fluid exits the motor at an outlet port located at an opposite end of the crescent-shaped gap. This process is continued, with pressurized fluid acting upon the extended vanes, imparting rotational movement to the rotor. The rotor, in turn, rotates an attached shaft which is otherwise connected to a discrete device, such as a fan.

As previously described, such prior art rotary vane motors are well adapted for powering tools such as pneumatic wrenches and grinders where the required operating speeds of the motor shaft are greater than 2,000 rpm and where a pressurized drive fluid in the form of a supply of compressed and lubricant-containing air is plentifully and cheaply supplied by a shop air compressor. While widely accepted, the standard rotary vane motor design does have certain deficiencies.

In particular, it is recognized that the standard rotary vane motor design results in certain efficiency losses. This loss of efficiency is due to the leakage (or "blow-by") of compressed air between the outer edges of the rotating vanes and the interior wall of the housing. With most applications, however, this loss of efficiency is relatively inconsequential, comprising a relatively small percentage of the overall air mass that flows through the motor at speeds of 2000 rpm or greater. Additional losses can occur due to friction between the vanes and the housing, and more importantly between the vanes and their individual slots. Once again, this friction-created problem is normally inconsequential in machine shop applications as entrained oil or other lubricants typically present in the shop air used to drive such motors keeps the internal friction of the motor down to an acceptable level.

Generally speaking then, the problems associated with the standard rotary vane motor do not rise to a level of great concern with standard shop type applications. However, prior art motor designs are not well-suited for use at relatively low rotational speeds (i.e., under 1500 rpm) or in environments where the pressurized drive fluid contains no lubricant or moisture, such as where it is cryogenically generated. Such an application for a rotary vane motor may occur, for example, in a cryogenic refrigeration system powered by a tank of liquefied carbon dioxide. In such an application, the motor is used to drive an evaporator blower and an alternator to recharge the battery that powers the refrigeration control system, and low rotational speeds are preferred to enhance the efficiency the fan blades of the blower. Because lower volumes of compressed gas are passed through the motor housing at lower speeds below 2000 rpm, the blow-by of gas between the vanes and the side walls of the housing can result in a 20% or greater loss of efficiency in prior art designs, where efficiency is defined as the ability of the motor to convert the energy of the compressed gas into rotary power.

Additionally, the standard rotary vane motor design efficiency decreases when the pressurized fluid used to power the device does not contain lubricants. Once again, this problem is quite prevalent with a cryogenic refrigeration system powered by a tank of liquefied carbon dioxide. Attempts have been made to overcome this friction problem through the use of self-lubricating plastic vanes. While the use of vanes formed from self-lubricated plastic material can ameliorate the frictional problems encountered when the pressurized gas contains no lubricant, the relatively light weight of such vanes can create a sealing problem at low rpm rates utilized in the above-referenced cryogenic refrigeration system. More particularly, the centrifugal force that tends to sling each vane into engagement against the inner surface of the housing may not be of sufficient magnitude to create an effective sealing engagement between the vane and the housing interior.

Other attempts to overcome the frictional problems associated with non-lubricated pressurized fluid have included revising the vane design. Unfortunately, however, it is impossible to eliminate the frictional interaction between the vane and its associated slot. Even more problematic is that liquid carbon dioxide can contain traces of moisture or other viscous impurities. These impurities find their way into the vapor motor and combine with the wear particles from the motor vanes themselves to further amplify frictional effects, resulting in sticking of the vanes. Over time, the motor will no longer start and the system becomes stagnant with dry ice.

Finally, the standard rotary vane motor design loses efficiency under extremes of temperature which can occur, for example, when the drive gas originates from a cryogen such as liquid carbon dioxide. When such a gas is used, the internal components of the motor may be subjected to temperature extremes ranging from −100° F. to +130° F., depending upon the temperature of the refrigerated space and the ambient temperature. Under such conditions, even if the vanes, the rotor slots and the internal dimensions of the housing are carefully dimensioned in order to minimize inefficiencies caused by blow-by, such dimensioning does not hold up over such a broad range of temperature extremes due to the different thermal coefficient of expansions of the different materials forming these components. As a result, the opportunity for binding or sticking of vanes within a respective motor housing is greatly magnified.

Rotary vane motors have proven to be highly useful in a number of applications. However, the inefficiencies associated with the standard design render the rotary vane motor of limited value in certain cases, such as when powered by vaporized liquid carbon dioxide. Therefore, a need exists for a rotary vane motor that is capable of efficiently running at low rpm with cryogenic gas in order to drive certain types of blowers and other devices which operate best at low rpm. In this regard, such a rotary vane type motor should be designed to eliminate the problems associated with friction and other impediments to proper vane movement within an associated slot.

The foregoing illustrates limitations known to exist in prior art methods and apparatus. Thus, it is apparent that it would be advantageous to provide an invention that overcomes the limitations. Accordingly, a suitable alternative is provided including features more fully disclosed hereinafter.

SUMMARY OF THE INVENTION

The present invention provides a high efficiency rotary vane motor adapted to operate at low rpm from a source of pressurized gas, such as cryogenic gas. The rotary vane motor includes a housing defining an inner cylindrical opening which is connected to a primary inlet assembly and an outlet assembly, first and second plates attached to the housing at opposite sides of the cylindrical opening, a rotor having a plurality of radially oriented slots, a plurality of vanes slidably movable within the slots and a shaft for rotatably mounting the rotor in an eccentric position within the cylindrical opening. The first end plate includes a slot positioned for fluid communication with one of the plurality of radially oriented slots so as to direct pressurized fluid from a secondary inlet assembly to the slot. In the preferred embodiment, the secondary inlet assembly receives pressurized fluid from the source of pressurized gas otherwise feeding the primary inlet assembly of the housing.

In the preferred embodiment, each of the plurality of vanes is a generally rectangular plate having a leading edge and a trailing edge including a groove or grooves formed at a lower end of the trailing edge. During use, the source of pressurized fluid directs pressurized fluid to the primary inlet assembly and the secondary inlet assembly. The pressurized fluid entering at the secondary fluid inlet is directed via the slot in the first end plate to one of the plurality of radially oriented slots in the rotor. The vane slidably maintained within the slot receiving the pressurized fluid is forced radially outward by the pressurized fluid until the outer vane edge sealably contacts an outer surface of the cylindrical opening. The pressurized fluid entering at the primary inlet assembly is directed at an extended vane, previously forced into sealing engagement with an interior of the housing via the first end plate slot. This action imparts a rotational force on the rotor, via the vane, and thus on the shaft. As the rotor continues to rotate, the vanes remain in the extended position relative to the slot due to centrifugal force and the pressurized fluid previously introduced via the secondary inlet assembly. Due to the geometry of the components, the volume of the space defined between the vanes, the rotor, and the housing bore increases as the rotor/vanes move past the primary inlet region. The pressurized fluid thus expands and its pressure energy is converted to mechanical energy rotating the vanes/rotor and the pressure and temperature of the fluid drops. However, after a certain amount of rotation, the volume of the space (between the vanes as defined earlier) begins to decrease. This is when the now low pressure fluid exits at the outlet assembly. The exact locations of the inlet and outlet for the fluid can be computed for the particular application and this is well known in the prior art. Finally, in the preferred embodiment, following release at the outlet assembly, the groove at the trailing edge of the vane allows the gas maintained within the slot to be released as the vane is forced inwardly relative to the slot.

DETAILED DESCRIPTION OF THE INVENTION

Figure 1:
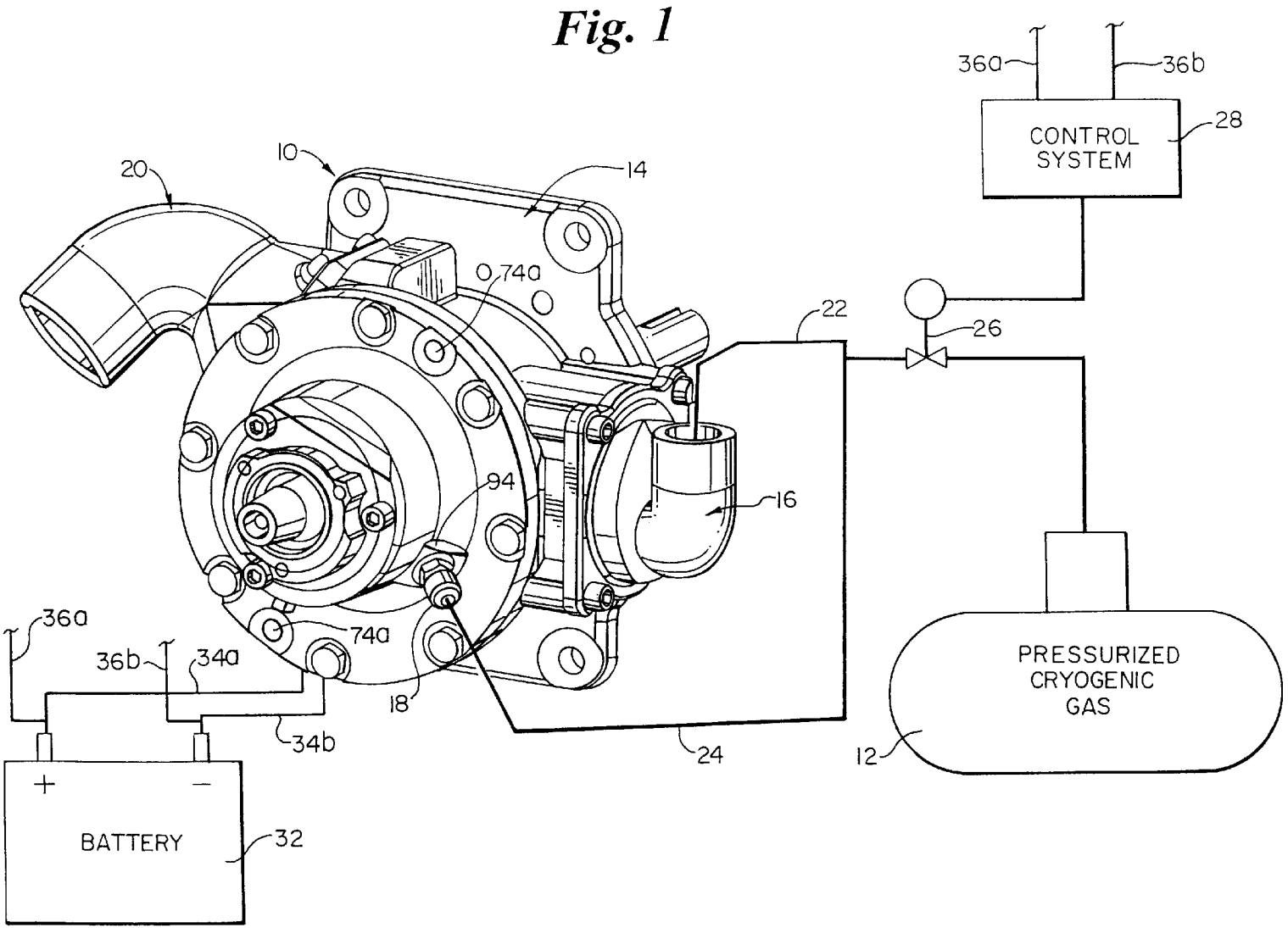
FIG. 1 is a perspective view of a rotary vane motor in accordance with the present invention, shown in combination with a source of drive fluid in the form of pressurized cryogenic gas.

FIG. 1 shows a rotary vane motor 10 of the present invention as part of an evaporator blower system. In particular, the rotary vane motor 10 of the present invention is preferably adapted to be driven by a source 12 of pressurized cryogenic gas, such as carbon dioxide generated from liquid carbon dioxide. In general terms, the rotary vane motor 10 includes a housing 14, a primary inlet assembly 16, secondary inlet assembly 18 and an outlet assembly 20. The source 12 of pressurized gas is connected to the primary inlet assembly 16 via a primary inlet conduit 22. Similarly, the source of pressurized gas 12 is connected to the secondary inlet assembly 18 via a secondary inlet conduit 24. The specific amount of gas allowed to flow into the primary and secondary inlet assemblies 16, 18 is modulated by a motor controlled valve 26 which receives signals from a microprocessor-operated control system 28.

The rotary vane motor 10 of the present invention is preferably designed to drive an evaporator blower (not shown) that operates most efficiently at low RPMs, and an alternator (not shown) in order to maintain a charge in a battery 32 which in turn powers the previously-mentioned control system. The alternator is connected to the battery 32 via cables 34*a* and 34*b*, and the control system 28 is in turn connected to the battery 32 by means of power cables 36*a* and 36*b*.

Rotary Vane Motor 10

Figure 2:
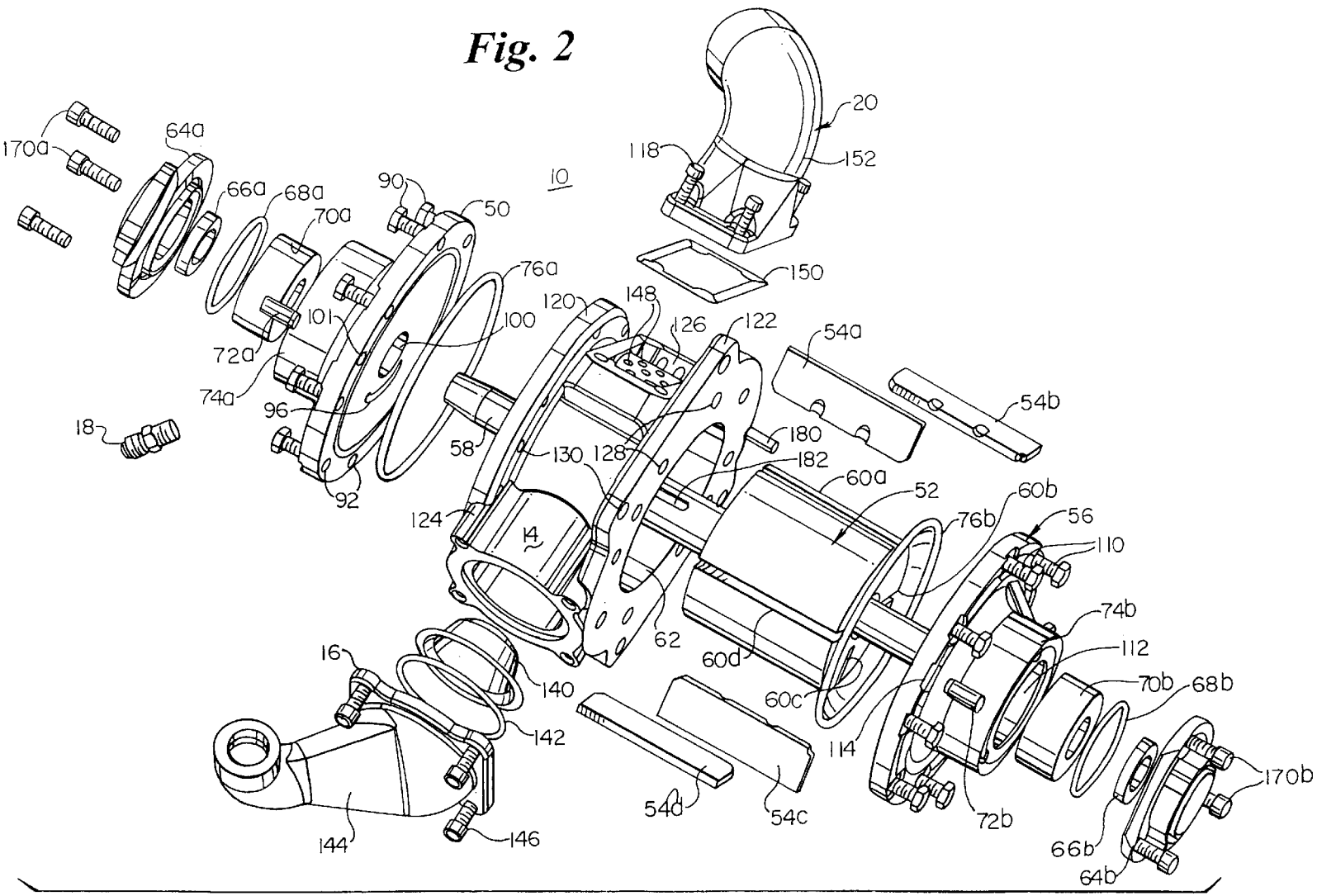
FIG. 2 is an exploded perspective view of the rotary vane motor of the present invention.

The rotary vane motor 10 is shown in greater detail in FIG. 2. The rotary vane motor 10 includes the secondary inlet assembly 18, a first end plate 50, the housing 14, the primary inlet assembly 16, the outlet assembly 20, a rotor 52, vanes 54*a*–54*d*, a second end plate 56 and a shaft 58.

As described in greater detail below, the rotor 52 is secured about the shaft 58 and includes four radially oriented slots 60*a*–60*d* for slidably receiving the vanes 54*a*–54*d*. The rotor 52 is rotatably maintained in an eccentric position within a cylindrical opening 62 in the housing 14. Opposite ends of the shaft 58 are in turn rotatably mounted in the opposing first end plate 50 and the second end plate 56. In this regard, the rotary vane motor 10 of the present invention further includes bearing retainers 64*a* and 64*b*, annular seals 66*a* and 66*b*, bearing O-rings 68*a* and 68*b*, bearings 70*a* and 70*b*, dowel pins 72*a* and 72*b* (one of two for each side shown in FIG. 2), annular shoulders 74*a* and 74*b*, and end plate O-rings 76*a* and 76*b*. Finally, as previously indicated, the primary inlet assembly 16 and the outlet assembly 20 are attached to opposite sides of the housing 14, whereas the secondary inlet assembly 18 is attached to the first end plate 50.

First and Second End Plates 50, 56

The first end plate 50 is preferably a cylindrical body integrally formed with the annular shoulder 74*a* and includes bolts 90, bolt passages 92, an inlet port 94, a kidney-shaped slot 96, an annular groove 98, a shaft receiving bore 100 and a registered dowel hole 101 (one for each dowel as shown in FIG. 1). The bolt passages 92 are sized to receive the bolts 90 to attach the first end plate 50 to the housing 14. In order to ensure a fluid-tight seal between the first end plate 50 and the housing 14, the annular groove 98 is sized to receive the O-ring 76*a*. The shaft receiving bore 100 is provided for conducting an end of the shaft 58. Notably, the shaft receiving bore 100 is not concentric with respect to the circular first end plate 50, but instead is off-center, such that upon final assembly the rotor 52 is mounted eccentrically with respect to the cylindrical opening 62 within the housing 14. The registered dowel holes 101 are sized to receive the dowel pins 72*a*.

Figure 3:
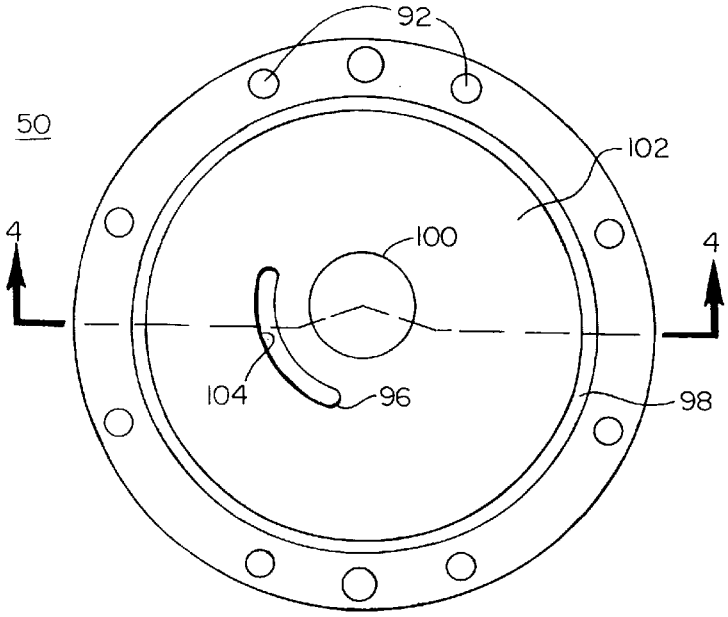
FIG. 3 is a side view of a first end plate component of the rotary vane motor of the present invention.

As shown in FIG. 3, the kidney-shaped slot 96 preferably extends 90° about an interior face 102 of the first end plate 50. In the preferred embodiment, the kidney-shaped slot 96 has a width of 0.188 inches and is positioned at a centerline radius of 0.944 inches. Importantly, the size and location of the kidney-shaped slot 96 need not be precise. Additionally, the kidney-shaped slot 96 need not be "kidney" in shape, as alternative shapes are equally acceptable. It is only necessary that the kidney-shaped slot 96 be sized and positioned to provide fluid from the secondary inlet assembly 18 (FIG. 2) to at least one of the radially oriented slots 60*a*–60*d*, as described in greater detail below.

Figure 4:
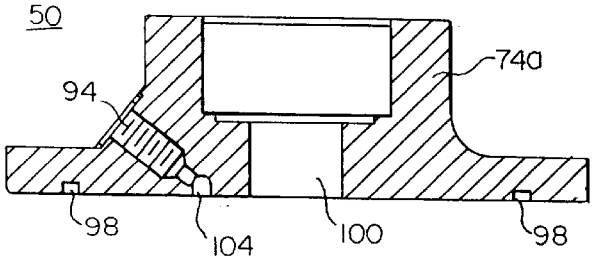
FIG. 4 is a front, cross-sectional view of the first end plate, including a secondary input along the line 4—4 of FIG. 3.

As shown in FIG. 4, the inlet port 94 is preferably threaded to sealingly receive the secondary inlet assembly 18 (shown in FIG. 2). Further, the inlet port 94 is fluidly connected to a bleed passage 104 which in turn is fluidly connected to the kidney-shaped slot 96 shown in FIG. 3. Thus, fluid entering the inlet port 94 is directed through the bead passage 104 to the kidney-shaped slot 96. As shown in FIG. 4, the inlet port 94 is preferably formed at an angle between the first end plate 50 and the integrally formed annular shoulder 74*a*. The inlet port 94, however, can be positioned at a variety of locations and orientations so long as fluid communication between the secondary inlet assembly 18 (FIG. 2) and the kidney-shaped slot 96 is provided.

In the preferred embodiment, the first end plate 50 is formed from a ferritic alloy, such as cast iron, for durability, wear resistance and the fact that the thermal coefficient of expansion of such metals is close to that of commercially available bearing steel. Additionally, the preferred first end plate 50 includes an electroless nickel plate finish. It should be recognized, however, that other materials can be used so long as a solid plate 50 is provided. Further, the nickel finish is in no way a requirement.

Returning to FIG. 2, the second end plate 56 is highly similar to the first end plate 50, but does not include the inlet port 94 or the kidney-shaped slot 96. Thus, the second end plate 56 is preferably a circular body, integrally formed with the annular shoulder 74*b*. The second end plate 56 includes bolts 110, bolt passages (not shown), an annular groove (not shown), a shaft receiving bore 112 and a registered dowel hole 114 (there are two dowel holes similar to those of plate 50, only one is shown here). The bolt passages are sized to receive the bolts 110 for securing the second end plate 56 to the housing 14. In this regard, the annular groove (not shown) seats the end plate O-ring 76*b* in order to ensure a fluid-tight seal between the second end plate 56 and the housing 14. Finally, the registered dowel holes 114 are sized to maintain the dowel pins 72*b*.

Similar to the first end plate 50, the second end plate 56 is preferably made from a ferritic alloy, such as cast iron, for durability, wear resistance, and the fact that the thermal coefficient of expansion of such metals is close to that of commercially available bearing steel. However, it is recognized that other types of strong, rigid material are equally acceptable. Second end plate 56 can include a kidney-shaped slot disposed in mirror image with respect to slot 96 of plate 50.

Housing 14

The housing 14 is preferably an annular body defining the cylindrical opening 62 and includes a first annular flange 120, a second annular flange 122, a tubular inlet neck 124 and an exhaust area 126. The tubular inlet neck 124 and the exhaust area 126 are formed on generally opposite sides of the housing 14. As described in greater detail below, the tubular inlet neck 124 and the exhaust port 126 are fluidly connected to the cylindrical opening 62 for receiving and expelling fluid, respectively.

The first and second annular flanges 120, 122 are configured to secure the first and second end plates 50, 56, respectively. In this regard, each of the first and second annular flanges 120, 122 includes threaded bores 128 for threadably receiving the bolts 90, 110 of the first and second end plates 50, 56. Finally, each of the annular flanges 120, 122 includes dowel registration holes 130 for receiving the dowel pins 72*a*, 72*b*.

The tubular inlet neck 124 is preferably sized to receive the primary inlet assembly 16. In this regard, the primary inlet assembly 16 preferably includes a screen filter cup 140, an inlet O-ring 142 and an intake manifold 144. The screen filter cup 140 is designed to filter out solid debris from the cryogenic gas emanating from the source of pressurized cryogenic gas 12 (FIG. 1). The filter cup 140 is mounted in the integrally formed, tubular inlet neck 124. The intake O-ring 142 is disposed around the outer periphery of the filter cup 140 to effect a fluid-tight seal between the intake manifold 144 and the tubular inlet neck 124 which are secured together by means of bolts 146. Similarly, the exhaust area 126 includes a plurality of exhaust ports 148. The outlet assembly 20 includes a gasket 150 and an exhaust manifold 152. The gasket 150 is disposed between the exhaust manifold 152 and the plurality of exhaust ports 148 to prevent leakage therebetween. Finally, the exhaust manifold 152 is bolted over the plurality of exhaust ports 148.

In the preferred embodiment, the housing 14 is formed from a ferritic alloy, such as cast iron, for durability, wear resistance, and the fact that the thermal coefficient of expansion of such metal is close to that of a commercially available bearing steel. While it could be possible to fabricate this component out of lighter metals, such as aluminum, the relatively greater heat conductivity and higher coefficient of thermal expansion that such metals typically have makes them less desirable for use in a rotary vane motor powered by a cryogenic gas since the initial exposure of such metals to gas may cause undesirable localized thermal differential contraction, which in turn can interfere with the smooth functioning of the motor 10. Preferably, the interior of the housing 14 should have about an 8 microinch finish hard coated to about Rockwell C58. Additionally, the surface should be coated with commercially available, friction reducing finishes such as electroless nickel or plasma sprayed with molybdenum and Teflon® impregnated. It should be recognized, however, that other materials and finishes are equally acceptable.

Rotor 52 and Vanes 54*a*–54*d*

As previously described, the rotor 52 is a cylindrical body and preferably includes four radially oriented slots 60*a*–60*d* uniformly spaced around the axis rotation of the rotor 52 every 90°, although different numbers of slots and vanes could be used as well. The rotor 52 is preferably sized to be slidably mounted on the shaft 58. As will be discussed in more detail below, the mounting between the shaft 58 and the rotor 52 allows some degree of slidable, axial movement to occur between these components in order to equilibrate the tight clearances between the side edges of the rotor 52 and vanes 54*a*–54*d* and the inner surfaces of the first and second end plates 50, 56 that obstruct blow-by.

Similar to the housing 14, the rotor 52 is preferably formed from a ferritic alloy, such as cast iron, for durability, wear resistance, and the fact that the thermal coefficient of expansion of such metal is close to that of a commercially available bearing steel. Finally, the surface finish of the radially aligned slot 60*a*–60*d* should be controlled with an approximately 32 microinch finish to reduce friction with the vanes 54*a*–54*d*.

Figure 5:
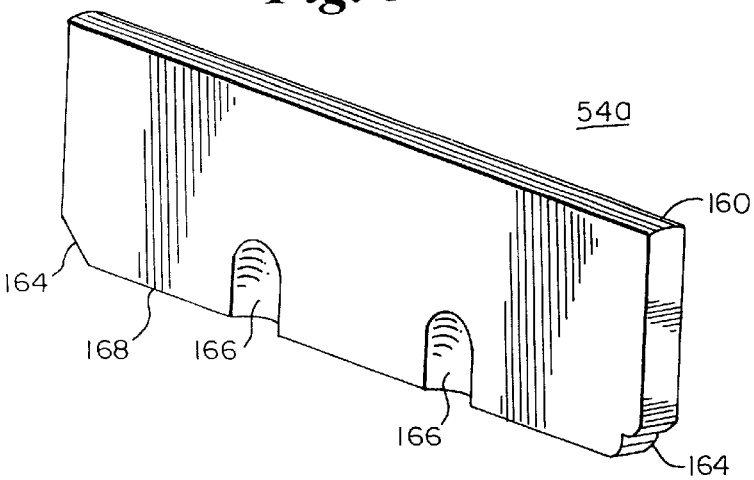
FIG. 5 is an enlarged perspective view of a vane utilized with the rotary vane motor of the present invention.

Each of the vanes 54*a*–54*d* is configured to be slidably disposed within one of the radially oriented 60*a*–60*d*. With reference to FIGS. 2 and 5, each of the vanes 54*a*–54*d* is substantially rectangular and includes an outer edge 160, a trailing face 162, contoured corners 164, grooves 166 and an inner edge 168. The outer edge 160 is preferably configured to slidingly and sealingly engage the surface of the cylindrical opening 62 of the housing 14. In order to maximize sealing contact between the vanes 54*a*–54*d* and the inner surface of the housing 14, the leading edge 160 of each of the vanes 54*a*–54*d* has a rounded profile (as seen in FIG. 5) which is partially complementary in shape to the rounded profile of the inner surface of the cylindrical opening 62 of the housing 14. Such dimensioning results in the attainment of surface (as opposed to line) contact between the edge 160 of the vanes 54*a*–54*d*, and the inner surface of the cylindrical opening 62 of the housing 14.

As described in greater detail below, each of the vanes 54*a*–54*d* slides within one of the radially oriented slots 60*a*–60*d* in the rotor 52. In this regard, the inner edge 168 is configured to be disposed near the center of the rotor 52. Each of the vanes 54*a*–54*d* includes the contoured 45° corners 164 to facilitate movement within the radially oriented slots 60*a*–60*d*. Finally, the trailing face 162 includes two of the grooves 166. The grooves 166 are sized to facilitate relief of pressurized fluid otherwise trapped between the inner edge 168 of the vane 54*a*–54*d* and the rotor 52. Each of the grooves 166 preferably have a width of 0.250 inches, a length of 0.32 inches and a depth of 0.10 inches, although other dimensions are equally acceptable. Similarly, while the vane 54*a* in FIG. 5 is shown as including two of the grooves 166, a greater or lesser number can be used.

Because the rotary vane motor 10 is particularly adapted to be driven by a dry, lubricant-free cryogenic gas, each of the vanes 54*a*–54*d* is preferably formed from a tough, self-lubricating polyamide plastic material. Moreover, in order to maintain a gas type seal between side edges of the vanes 54*a*–54*d* and the inner surfaces of the first and second end plates 50, 56, each of the vanes 54*a*–54*d* should be formed from a material having substantially the same coefficient of thermal expansion as the cast iron that forms the rotor 52 in the housing 14. One such polyamide plastic material is Aurum, available under the trade name JCL 3030 from EGC Corp., located in Houston, Tex.

Assembly of the Rotary Vane Motor 10

With reference to FIG. 2, the rotary vane motor 10 is assembled basically as follows: The primary inlet assembly 16 is attached to the tubular inlet neck 124 of the housing 14 such that the screen filter cup 140 nests within the tubular inlet neck 124. Similarly, the outlet assembly 20 is attached to the exhaust area 126 of the housing 14.

The rotor 52 is slidably mounted on the shaft 58. Each of the vanes 54*a*–54*d* are slidably disposed within one of the radially oriented slots 60*a*–60*d* of the rotor 52, respectively. The rotor 52 and the shaft 58 are then disposed within the cylindrical opening 62 of the housing 14. The first and second end plates 50, 56 are secured to the housing 14 about opposite ends of the shaft 58. In particular, the first end plate 50 is secured to the first annular flange 120 by bolts 90. Similarly, the second end plate 56 is attached to the second annular flange 122 by the bolts 110. In order to ensure a fluid-tight seal between the end plates 50, 56 and he annular flanges 120, 122 of the housing 14, the end plates O-rings 76*a* and 76*b* are seated in the annular grooves 98 of the end plates 50, 56, respectively.

The opposite ends of the shaft 58 pass through the shaft receiving bores 100, 112 of the end plates 50, 56, respectively. Notably, as previously described, the shaft receiving bores 100, 112 are not concentric with respect to the end plates 50, 56, but instead are off-center, such that the rotor 52 is mounted eccentrically with respect to the cylindrical opening 62 in the housing 14. In each of the first and second end plates 50, 56, the shaft 58 is journaled in the annular seals 66*a*, 66*b* in order to prevent pressurized drive gas from escaping through the end plates 50, 56. Each of the end plates 50, 56 further includes the bearings 70*a* and 70*b*, respectively, for rotatably mounting the opposite ends of the shaft 58 with a minimum amount of friction. Each of the bearings 70*a*, 70*b* is disposed within the annular shoulder 74*a*, 74*b*, respectively, projecting from the end plates 50, 56, and is secured in this position by means of the bearing retainers 64*a* and 64*b*. Each of the bearing retainers 64*a*, 64*b*, in turn, is secured on to the annular shoulders 74*a* and 74*b* by means of bolts 170*a* and 170*b*. Notably, the position of the annular seals 66*a* and 66*b*, and the bearings 70*a* and 70*b* may be reversed on the shaft 58 if desired.

Because of the off-centered position of the shaft receiving bores 100, 112 with each of the end plates 50, 56, it is extremely important that they be properly aligned with one another with respect to the housing 14. Otherwise, a small misalignment may create a skewing or twisting of the shaft 58 with respect to the housing 14, which in turn can cause interference between the rotor 52 and the interior surface of the housing 14. To this end, the dowel pins 72*a* and 72*b* (two per plates 50 and 56 each) are provided between the end plates 50, 56 and the annular flanges 120, 122 integrally formed around the side edges of the housing 14. The dowel pins 72*a*, 72*b* are mounted within the dowel registration holes 101, 114 in the end plates 50, 56 and dowel registration holes 130 in the annular flanges 120, 122. The provision of such dowel pins 72*a*, 72*b* insures an axial alignment between the shaft receiving bores 100, 112 of the opposing first and second end plates 50, 56.

The secondary inlet assembly 18 is threadably secured to the inlet port 94. With this configuration, fluid passes from the secondary inlet assembly 18 to the kidney-shaped slot 96 as previously described.

Key 180 extends from the slot 182 and engages the rotor 52. The key 180 transmits rotational movement of the rotor 52 to the shaft 58, which in turn performs useful work, i.e., by the operation of an attached blower (not shown). As an alternative to the key fit, a spline fit could be used as well.

Operation

Figure 6:
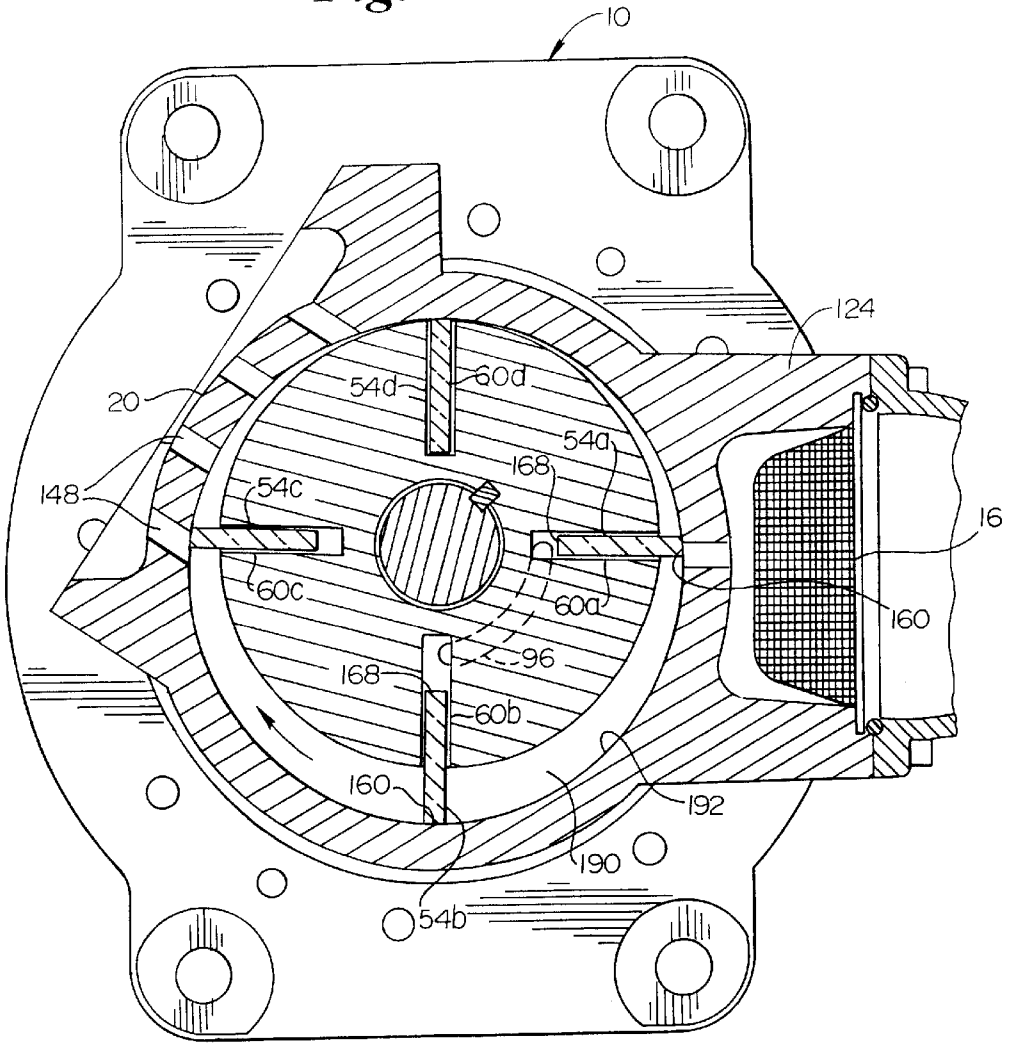
FIG. 6 is a side, cross-sectional view of the rotary vane motor illustrated in FIG. 1 as it would appear with the exhaust manifold removed.

As shown in FIG. 6, the eccentric mounting of the shaft 58 and the rotor 52 relative to the cylindrical opening 62 of the housing 14 results in a crescent-shaped gap 190 between the rotor 52 and an interior wall 192 of the cylindrical opening 62. With this construction, the rotary vane motor 10 of the present invention operates similarly to previous designs. Namely, when the driving fluid, such as cryogenic gas, is admitted through the primary inlet assembly 16, such gas flows through the tubular inlet neck 124 and into one side of the crescent-shaped gap 190 where it interacts with the vanes 54*a*–54*d* nearest the primary inlet assembly 16 (54*a* and 54*b* in FIG. 6). The pressurized gas pushes against the trailing side of the vane 54*a*–54*d*, causing the rotor 52 to rotate. As the rotation proceeds, the gas expands to fill the greater volume located toward the mid-section of the crescent-shaped gap 190, similar to previous designs. However, unlike previous designs which rely upon centrifugal force and/or other means to force the vanes 54*a*–54*d* outward from the rotor slots 60*a*–60*d* into contact with the interior wall 192 of the housing 14, a small amount of pressurized gas forces the vanes 54*a*–54*d* outwardly via the kidney-shaped slot 96.

More particularly, with rotation of the rotor 52 (clockwise in FIG. 6), as one of the radially orientated slots (60*a* in FIG. 6) comes in to fluid communication with the kidney-shaped slot 96, pressurized gas from the secondary inlet assembly 18 (FIG. 2) enters the rotor slot 60*a* and imparts a force upon the inner edge 168 of the maintained vane (54*a* in FIG. 6). This forces the vane 54*a* radially outward relative to the rotor slot (60*a* in FIG. 6), such that the leading edge 160 sealingly engages the interior wall 192 of the cylindrical opening 62. Proper timing of fluid through the kidney-shaped slot 96 relative to influx of fluid through the primary inlet assembly 16 is known to one skilled in the art. As the vane 54*a* continues its rotational movement around the crescent-shaped gap 190, it slidably extends radially outwardly due to the force applied at the inner edge 168 by the previously supplied gas. Expansion and work output continues until the trailing face 162 of the vane 54*a* moves just past the first exhaust port 148. At this juncture, the pressurized drive gas (now at a lower pressure) has completed its useful work, and is released through the outlet assembly 20.

Once the drive gas has been released, the rotor 52 continues rotational movement. During this step in operation of the rotary vane motor 10, the vane (at the point 54*c* in FIG. 6) begins to slide radially inwardly due to the decrease in the gap 190. This retraction continues until the point of approximate contact between the rotor 52 an the interior wall 192 of the cylindrical opening 62, at which point the vane (represented by the vane 54*d* in FIG. 6) is fully retracted.

Figure 7:
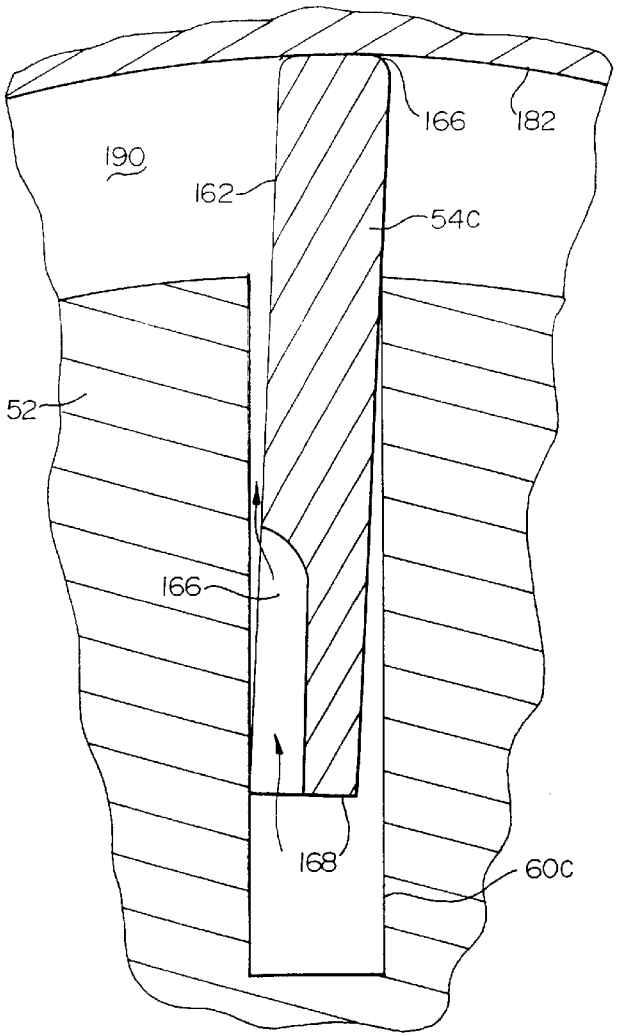
FIG. 7 is an enlarged, cross-sectional view of a vane and rotor slot of the rotary vane motor in accordance with the present invention.

As shown in FIG. 7, the grooves 166 in the vane 54*c* is appropriately sized to allow the previously supplied pressurized gas to escape from beneath the inner edge 168 of the vane 54*c*. Thus, following exhaust, the vane 54*a*–54*d* easily retracts back into its respective rotor slot 60*a*–60*d*, as the gas originally utilized to extend the vane 54*a*–54*d* can now escape through the grooves 166. In other words, the grooves 166 serve to relieve any gas trapped under the vane 54*a*–54*d* as the vane 54*a*–54*d* begins to retract. Finally, all during the rotation of the rotor 52, ,the vanes 54*a*–54*d* maintain an equal and close clearance to the interior surfaces of the end plates 50, 56 (FIG. 2).

It will be understood that this disclosure, in many respects, is only illustrative. Changes may be made in details, particularly in matters of shape, size, material, and arrangement of parts without exceeding the scope of the invention. Accordingly, the scope of the invention is as defined in the language of the appended claims.

What is claimed is:

1. In a rotary vane motor having a rotor eccentrically mounted for rotation within a cylinder defined by a housing, end plates with faces bounding the ends of the rotor within the cylinder and fluid inlet and outlet means connecting the cylinder to pressurized gas, the rotor having radial slots with vanes slidably carried within the slots, the improvement which comprises:

slot means within the face of at least one of said end plates and positioned to be in fluid communication with each of said rotor slots as each slot moves between said fluid inlet and outlet means during rotation of said rotor; and means providing pressurized gas to said radial slots via said end plate face slot means.

2. The rotary vane motor of claim 1 wherein said end plate face slot means are positioned to provide pressurized gas to said radial slot behind the vanes within said radial slots.

3. The rotary vane motor of claim 1 wherein said slot means are positioned within said end plate face to be in fluid communication with at least one of said rotor slots during rotation of said rotor.

4. The rotary vane motor of claim 1 wherein said end plate face slot means are positioned to provide pressurized gas to a radial slot as each slot moves through approximately 90° of said rotor rotation.

5. The rotary vane motor of claim 1 wherein said end plate face slot means is arcuate having an arc of approximately 90°.

6. The rotary vane motor of claim 1 wherein said vanes have an inner edge within said rotor radial slot, an outer edge and a trailing face, said slot means being in fluid communication with said rotor radial slots behind said inner edges.

7. The rotary vane motor of claim 6 further comprising means for relieving gas pressure within said rotor radial slots.

8. The rotary vane motor of claim 6 wherein said vanes comprise means for relieving gas pressure within said rotor radial slots.

9. The rotary vane motor of claim 8 wherein said gas pressure relieving means comprises a plurality of grooves within said vanes.

10. The rotary vane motor of claim 9 wherein said grooves extend from said vane inner edge along said trailing face.

* * * * *